United States Patent [19]

Pagnotta et al.

[11] 3,967,353

[45] July 6, 1976

[54] GAS TURBINE BUCKET-ROOT SIDEWALL PIECE SEALS

[75] Inventors: Gasper Pagnotta, Rexford; John H. Eskesen, Schenectady, both of N.Y.

[73] Assignee: General Electric Company, Schenectady, N.Y.

[22] Filed: July 18, 1974

[21] Appl. No.: 489,799

[52] U.S. Cl. ..... 29/156.8 R; 228/215; 228/189; 416/213 R; 285/286; 403/272

[51] Int. Cl.[2] ..... B23P 15/04

[58] Field of Search ..... 416/213, 213 A, 97; 29/501, 480, 491, 490, 500, 156.8 R; 113/116 W, 116 Y; 228/215, 189, 175; 285/21, 22, 286, 416; 403/272

[56] References Cited

UNITED STATES PATENTS

| | | | |
|---|---|---|---|
| 2,659,964 | 11/1953 | Power et al. | 403/272 |
| 2,931,623 | 4/1960 | Hyde | 416/97 |
| 2,984,235 | 5/1961 | Johnson et al. | 285/286 |
| 3,101,532 | 8/1963 | Christensen | 285/286 |
| 3,446,482 | 5/1969 | Kydd | 416/97 X |
| 3,584,372 | 6/1971 | Larson | 219/118 |
| 3,610,769 | 10/1971 | Schwedland et al. | 416/97 X |
| 3,658,439 | 4/1972 | Kydd | 416/97 |
| 3,680,200 | 8/1972 | Terrill et al. | 29/500 |
| 3,707,750 | 1/1973 | Klass | 29/156.8 B |
| 3,708,846 | 1/1973 | Worner | 29/156.8 CF |
| 3,825,984 | 7/1974 | Linko et al. | 29/156.8 H |

FOREIGN PATENTS OR APPLICATIONS

| | | | |
|---|---|---|---|
| 219,360 | 1/1962 | Austria | 285/21 |
| 803,255 | 1/1951 | Germany | 285/22 |
| 22,396 | 10/1908 | United Kingdom | 285/22 |

*Primary Examiner*—Carl E. Hall
*Assistant Examiner*—Dan C. Crane
*Attorney, Agent, or Firm*—Charles T. Watts; Joseph T. Cohen; Jerome C. Squillaro

[57] ABSTRACT

An annular composite joint of wire and braze alloy fluid-tightly seals the bucket of a gas turbine to the root sidewall piece bridging the space provided between the two parts to eliminate the necessity for close tolerance fit.

4 Claims, 3 Drawing Figures

GAS TURBINE BUCKET-ROOT SIDEWALL PIECE SEALS

This invention relates generally to the fabrication of fluid-cooled gas turbines and is more particularly concerned with a new method of joining the buckets to the platform and with the resulting novel assembly including as a key element a bridging annular joint fluid-tightly sealing each bucket to the platform.

Liquid-cooled gas turbines of the open circuit system type disclosed and claimed in U.S. Pat. No. 3,658,439 issued Apr. 25, 1972, and assigned to the assignee hereof, have buckets secured to the turbine discs with the bucket tines received in interlocking engagement within grooves provided in the rim of the disc, the parts being brazed together as so assembled. The buckets have spanwise extending grooves formed in their air foil portions and are covered by metal skins which, with the grooves, define channels for cooling fluid flow. Metering of cooling liquid to the channels of each bucket is provided by the platform or root-sidewall piece, each bucket extending through its own opening in the platform with the bucket skin in liquid-tight fit in the platform opening.

In accordance with the present invention the essential fluid-tight sealing connection between the blade or bucket skin and the platform is readily made without need for high precision forming and shaping of either the bucket or the associated part of the platform. Moreover, the resulting structure, including as a key novel element an annular composite joint, fully meets physical strength requirements and at the same time represents a substantial advantage of economy of construction costs even though it involves use of material in addition to that required in the prior art designs.

Those skilled in the art will gain a further and better understanding of this invention and its objectives and advantages from the following detailed description taken in conjunction with the drawings accompanying and forming a part of this specification, in which.

Figure 2:
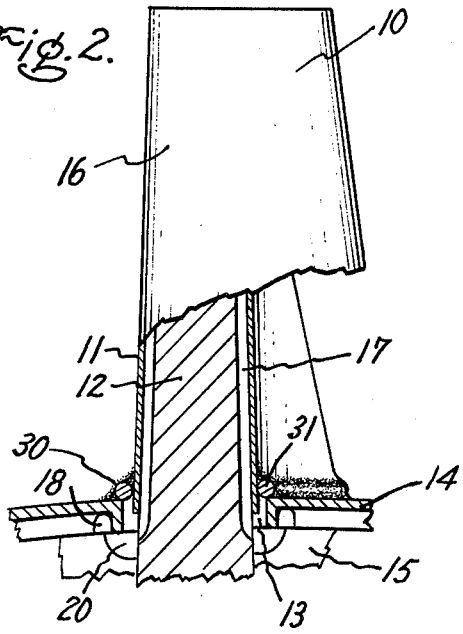
FIG. 2 is an elevational view of the assembly of FIG. 1 taken partly in section of line 2—2 thereof to illustrate the annular composite bridging joint seal feature of this invention.

It will be understood that preferably each of the buckets of the gas turbine fragmentarily shown in these drawings is joined in the indicated attitude to the adjacent or associated platform elements by means of the new composite bridging joint. Thus, in the illustrated embodiment turbine bucket 10 consisting of a sheet metal skin 11 brazed to a investment-cast, grooved, hollow core 12 extends through bucket opening 13 provided in the root-side-wall piece or platform 14. Bucket 10 is suitably secured to rim 15 of the turbine disc (not fully shown) in the manner above-described in reference to U.S. Pat. No. 3,658,439 so that its upper or airfoil portion 16 extends above the platform and channels 17 communicate with liquid passageways 18 between the platform and the rim of the disc, as shown in FIG. 2. Relief cuts 20 in the ribs of rim 15 ensure clear supply paths for liquid coolant from passageways 18 to channels 17 defined by the core grooves and the sheet metal skin of each bucket.

Figure 1:
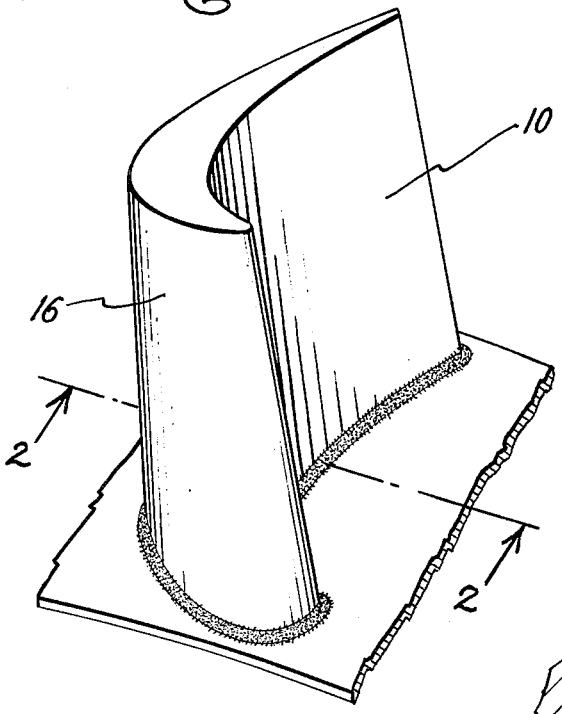
FIG. 1 is a perspective view of a turbine bucket and associated platform structure (fragmentarily shown) secured together in a preferred embodiment of this invention.
Figure 3:
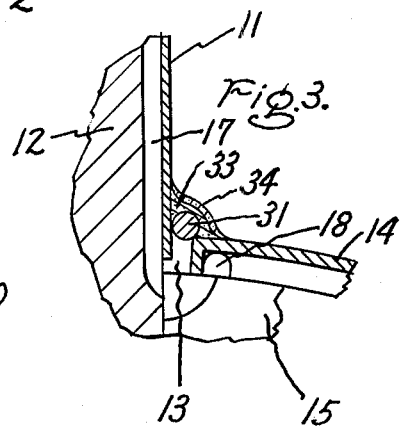
FIG. 3 is an enlarged fragmentary view showing in detail an alternative preferred form of novel joint seal combination of this invention.

Annular composite joint 30 shown in FIGS. 1, 2 and 3 consist in each case of a wire 31 of suitable metal which is disposed around the full length of the opening 13 in engagement with the upper surface of platform 14 and an annular surface portion of bucket 10 slightly above the upper end of opening 13. Wire 31 in this position is spotwelded at several points, suitably six or eight, around its length to both the bucket skin 11 and platform 14, being conformed over its length to the shape of the bucket skin so that only relatively small openings exist between the parts as assembled preliminary to the brazing operation which completes the bridging seal.

With the parts secured temporarily together in substantially the position shown in FIG. 2, a powdered mixture of braze alloy and binder is distributed over wire 31 around the full length of bucket opening 13 so as to substantially fill the spaces between the wire and the bucket skin 11 and between the wires and the top surface of platform 14. Heat then is delivered to the assembly to melt the braze material in place and thereafter the assembly is cooled so that the braze is solidified in position, fluid-tightly joining skin 11, wire 31 and the adjacent upper surface portion platform 14 around bucket opening 13. The bucket opening thus is bridged by a composite, annular, fluid-tight joint.

In the practice of this invention, bucket skin 11 and platform 14 may suitably be of pure nickel, a stainless steel, a nickel-base alloy such as one of the series marketed under the trade-name Inconel, or a cobalt-chromium nickel base alloy, but preferably in any such turbine structure the material of the bucket skin and that of the platform surface are the same. Wire 31 likewise may be of any of these materials but preferably will be matched to the bucket skin and the platform surface which it bears against.

Any suitable braze may be used but our preference with the above skin and platform surface materials is a copper-silver-nickel alloy. Alternatives include gold-nickel alloys and chromium-nickel alloys, it being understood that any braze material which is compatible with the metals or alloys of the parts to be joined may be used to obtain the new results and advantages of this invention.

In the construction of a gas turbine incorporating this invention, bucket openings were provided in the platform of size such that the space between the bucket skin and the platform was of the order of 0.005 to 0.040 inch. The bridging annular composite joint of this invention accordingly was of length slightly longer than that so that the space between the bucket skin and the platform was fluid-tightly bridged around the entire length of the bucket opening. Assembly of the components and fabrication particularly of the platform and the bucket and bucket skin were facilitated by virtue of the fact that there was no close tolerance requirement. The construction of the bridging composite seal was readily and quickly accomplished in much less than the time normally required to accomplish the close tolerance fit between each bucket and platform element. A nickel wire was used and the braze material was a copper-silver-nickel alloy powder contained in binder of isobutylementhacrylate.

After placement and spot-welding of wire 31 in position as shown in FIG. 2, nickel powder binder mixture 33 was introduced into the annular spaces between wire 31 and adjacent portions of bucket skin 11 and platform 14, as illustrated in FIG. 3. Then a layer 34 of the nickel powder binder fill 33 described above was deposited over wire 31 and the fill 33. The assembly was then furnace brazed under a dry hydrogen atmosphere (vacuum is an alternative) in the usual manner to produce the desired strong fluid-tight composite joint, the braze alloy having effectively wet the opposed joined surfaces of the bucket skin and platform as well as nickel powder fill 33.

We claim:

1. In the method of assembling a fluid-cooled gas turbine including the steps of locating buckets in their respective openings in a platform and securing the buckets to a turbine disc, the combination of the steps of shaping the platform to provide space of width from 0.005 to 0.040 inch between the buckets and the platform within the bucket openings, placing a wire in contact with the upper surface of the platform around the periphery of each bucket-receiving opening and in contact with an annular portion of the bucket skin above the platform, spot-welding each so located wire to the platform and to its respective bucket, covering each spot-welded wire around its length and at least partially filling annular spaces between each said wire and the bucket and the platform with a mixture of powdered braze alloy and binder, firing the assembly to melt the braze while maintaining the braze outside the bucket openings in the platform, and cooling and solidifying the braze in situ and thereby sealing each bucket fluid-tightly to the platform.

2. The method of claim 1 in which the bucket skins and the platform are of chromium-containing steel, the wires are of nickel and the braze alloy has a melting point temperature in the range from 700°C. to 1200°C.

3. The method of claim 1 in which the braze alloy powder and binder mixture is distributed both above and below the wire so as to substantially fill the annular spaces between the wire and the bucket and the platform.

4. The method of claim 1 in which nickel powder is placed between the wire and the bucket and the platform around the full length of the wire and in which the mixture of powdered braze alloy and binder is applied to cover the nickel powder and the wire over the full length of the wire.

* * * * *